US006533384B1

(12) United States Patent
Vega et al.

(10) Patent No.: US 6,533,384 B1
(45) Date of Patent: Mar. 18, 2003

(54) SYSTEM AND METHOD FOR SELECTIVE PRINTHEAD BASED SERVICING OPERATIONS

(75) Inventors: Ramon Vega, Barcelona (ES); Xavier Bruch, Barcelona (ES); Marc Serra, Barcelona (ES)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 09/984,535

(22) Filed: Oct. 30, 2001

(51) Int. Cl.[7] ..... B41J 29/393
(52) U.S. Cl. ..... 347/19
(58) Field of Search ..... 347/19, 14, 23, 347/12, 10, 11, 24, 43, 81, 74; 400/74

(56) References Cited

U.S. PATENT DOCUMENTS 4,835,435 A 5/1989 Yeung et al. ..... 310/324
5,455,608 A 10/1995 Stewart et al. ..... 347/23
6,086,190 A 7/2000 Schantz et al. ..... 347/81
6,238,112 B1 5/2001 Girones et al. ..... 400/74

FOREIGN PATENT DOCUMENTS

EP 1027987 A1 8/2000 ..... B41J/2/125

*Primary Examiner*—Hai Pham
*Assistant Examiner*—Charles W. Stewart, Jr.

(57) ABSTRACT

The time required to perform servicing operations may be substantially reduced by application of different criteria on different pens of a printing mechanism. The servicing operation routines for each of the pens may be individually established according to their characterizations which are based upon the ink drops to be fired from each of the pens. The timing of the servicing operations for the selected pens may be predicated upon a selected printmode to thereby substantially comply with a user's expectations of throughput and print quality. In addition, the nozzles of each of the printheads may be grouped according to their condition or health. Those nozzles having a condition that falls below a predetermined threshold value may undergo drop detections more frequently than other nozzles. In this respect, the throughput and the print quality of a printing operation may be adjusted according to user preferences.

20 Claims, 6 Drawing Sheets

SYSTEM AND METHOD FOR SELECTIVE PRINTHEAD BASED SERVICING OPERATIONS

RELATED APPLICATION

The following commonly assigned application, filed on Aug. 29, 2001, may contain some common disclosure and may relate to the present invention. Thus, the following application is hereby incorporated by reference:

U.S. patent application Ser. No. 09/940,435, entitled "METHOD AND APPARATUS FOR FOCUSED INK DROP DETECTION ".

FIELD OF THE INVENTION

This invention relates generally to inkjet printers. More specifically, the present invention relates to selective drop detection of printhead nozzles corresponding to the effect of the ink on print media fired from those nozzles.

BACKGROUND OF THE INVENTION

Inkjet printing mechanisms, e.g., printers, photocopiers, facsimile machines, etc., typically implement inkjet cartridges, often called "pens" to shoot drops of ink onto a sheet of print media, e.g., paper, fabric, textile, and the like. Some inkjet printing mechanisms carry an ink cartridge with an entire supply of the ink back-and-forth across the sheet. Other inkjet print mechanisms, known as "off-axis" systems, propel only a relatively small ink supply with the printhead carriage across the print zone, and store the main ink supply in a stationary reservoir, located off-axis from the path of the printhead travel. Typically, a flexible conduit or tubing is used to convey the ink from the off-axis reservoir to the printhead cartridge.

Pens typically have a printhead that includes very small nozzles on an orifice plate through which the ink drops are fired. The particular ink ejection mechanism within the printhead may take on a variety of different forms as known to those skilled in the art, such as those using piezoelectric or thermal inkjet technology. To print an image, the printhead is scanned back-and-forth across a print zone above the sheet, with the pen shooting drops of ink as it moves. By selectively firing ink through the nozzles of the printhead, the ink is expelled in a pattern on the print media to form a desired image (e.g., picture, chart, text and the like). The nozzles are typically arranged in one or more linear arrays along the printhead. If more than one, the two linear arrays are typically located side-by-side on the printhead, parallel to one another, and substantially perpendicular to the scanning direction. Thus, the length of the nozzle arrays defines a print swath or band. That is, if all the nozzles of one array were continually fired as the print head made one complete traverse through the print zone, a band or swath of the ink would appear on the sheet. The height of this band is known as the "swath height" of the pen, the maximum pattern of ink which can be laid down in a single pass.

The orifice plate of the printhead has a tendency to pick up contaminants, such as paper dust, and the like, during the printing process. Such contaminants may adhere to the orifice plate either because of the presence of ink on the printhead, or because of electrostatic charges. In addition, excess dried ink can accumulate around the printhead. The accumulation of either ink or other contaminants can impair the quality of the output by interfering with the proper application of ink to the print media. In addition, if color pens are used, each printhead may have different nozzles which each expel different colors. If ink accumulates on the orifice plate, mixing of different colored inks (cross-contamination) can result during use which may lead to adverse affects on the quality of the resulting printed product. Furthermore, the nozzles may become clogged, particularly if the printheads are left uncapped for a relatively long period of time. For at least these reasons, it is desirable to clear the printhead orifice plate of such contaminants on a substantially routine basis.

In this respect, servicing operations, including ink drop detections, are typically performed on the nozzles prior to, during, and/or after completion of the performance of a printing operation. In performing the servicing operations, inkjet printing mechanisms typically implement a service station located along the scanning direction. The service station typically performs a plurality of servicing operations on the nozzles, e.g., collecting spit ink, capping the nozzles, wiping the orifice plate, etc.

The manner and form of the servicing operations are typically controlled by a servicing protocol that uses a drop detector to determine whether any of the nozzles are operating in an improper manner, e.g., nozzle outs, paper crashes, and the like. As an example, a servicing operation may be triggered when the drop detector determines that a nozzle in a printhead is clogged or otherwise improperly ejecting ink. The servicing protocol may control the printheads of a printer mechanism to travel over the drop detector at certain times before, during and after performance of a printing operation. Typically, once the printheads are maneuvered over the drop detector, each of the nozzles contained in each of the printheads is tested. Although this type of complete nozzle testing is typically beneficial to the quality of the printed output, the amount of time required to perform the ink drop detections on all of the nozzles (e.g., known inkjet printing mechanisms may include six or more printheads, each of which may include two rows of 524 nozzles) typically negatively impacts throughput, i.e., amount of time required to print a plot, especially with regard to servicing operations performed during the printing process.

SUMMARY OF THE INVENTION

According to an aspect, the present invention pertains to a method of selective servicing operation performance. In the method, a degree of impact ink drops configured to be fired from each of a plurality of printheads has on a printed output is determined. Each of the printheads is characterized into at least one of a plurality of groups based upon the degree of impact of the ink drops. In addition, a selective servicing operation is performed on a first printhead group configured to fire ink drops having a predetermined degree of impact on the printed output.

According to another aspect, the present invention relates to an apparatus for operating a printing mechanism having a plurality of printheads, each printhead being configured to fire ink drops having various degrees of impact on a printed output. The apparatus includes a controller operable to control the plurality of printheads to fire ink drops onto a print medium to form the printed output. The controller also includes a memory configured to store the varying degrees of impact of the ink drops configured to be fired through the printheads. The controller is further operable to group the printheads according to the degrees of impact of each ink configured to be fired therefrom. The controller is operable to a control at least one of the printhead groups to undergo a selective servicing operation performance. The at least one of the printhead groups are those printheads configured to fire ink drops having a predetermined degree of impact on the printed output.

In comparison to known printing mechanisms and techniques, certain embodiments of the invention are capable of achieving certain advantages, including some or all of the following: (1) time savings in performance of servicing operations; (2) ink savings during the performance of ink drop detections; (3) substantial optimization of the servicing operation process; (4) substantial conformance of the servicing operation performances based upon user preferences. Those skilled in the art will appreciate these and other advantages and benefits of various embodiments of the invention upon reading the following detailed description of a preferred embodiment with reference to the below-listed drawings.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

Figure 1:
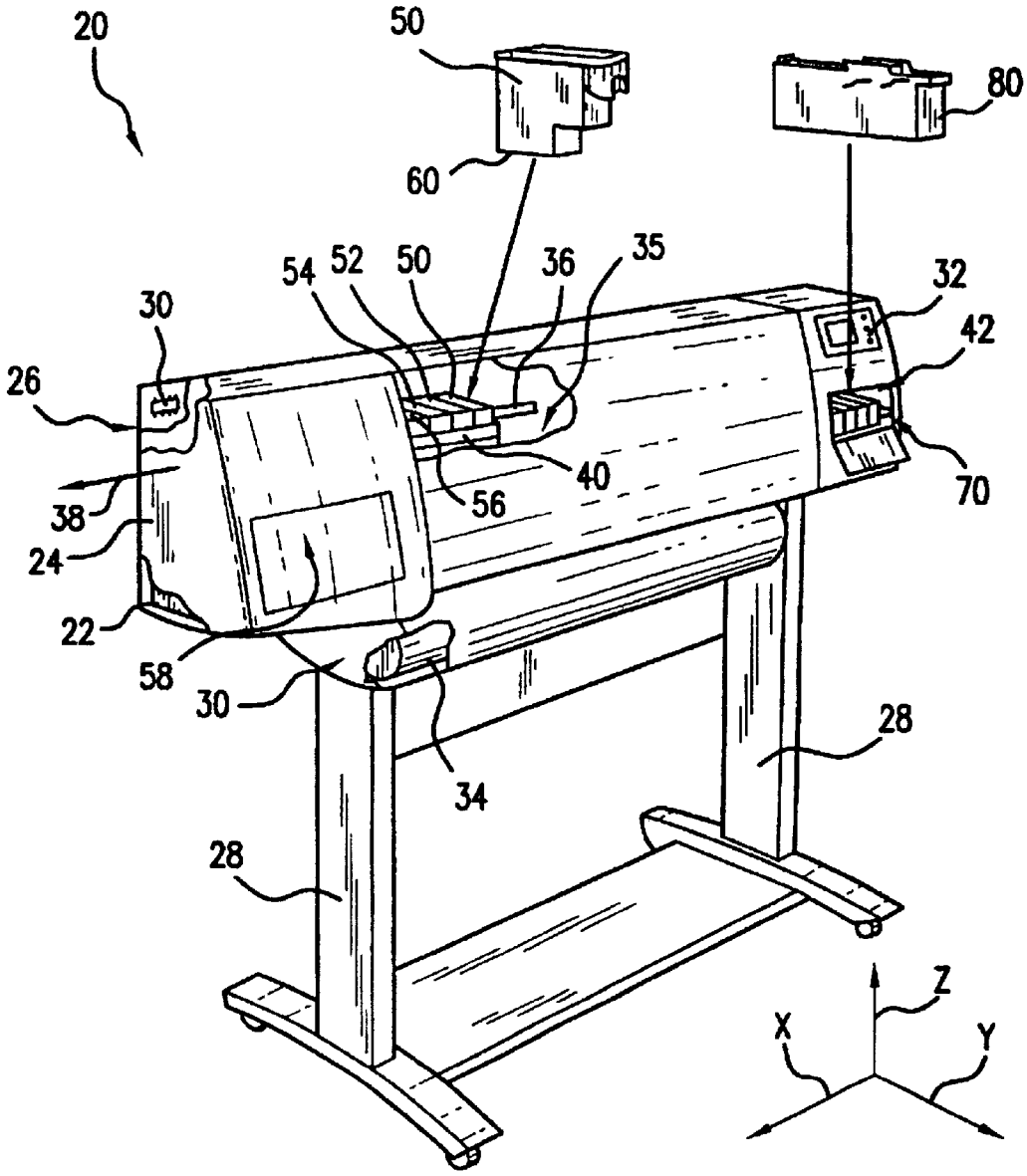
FIG. 1 is a perspective view of one form of an inkjet printing mechanism, here an inkjet printer.

For simplicity and illustrative purposes, the principles of the present invention are described by referring mainly to an exemplary embodiment thereof. In the following description, numerous specific details are set forth in order to provide a thorough understanding of the present invention. It will be apparent however, to one of ordinary skill in the art, that the present invention may be practiced without limitation to these specific details. In other instances, well known methods and structures have not been described in detail so as not to unnecessarily obscure the present invention.

According to an exemplary embodiment of the present invention, the amount of time required to perform servicing operations on a plurality of printheads may be substantially reduced by application of different criteria on different pens of a printing mechanism. For purposes of simplicity, the present disclosure describes the servicing operations in terms of ink drop detections. It should be understood that certain aspects of the present invention has equally suitable applicability to various other areas of servicing operations, e.g., wiping, capping, and the like.

It has been found that certain properties of ink drops (e.g., colors, chemical compositions, drop volumes, etc.) have differing degrees of impact on the quality of a printed product. For example, a missing black line may have a greater impact on a printed output than a missing yellow line, i.e., the missing black line will be more readily noticed than the missing yellow line. In addition, an ink drop having a relatively large drop volume may have a greater impact than an ink drop having a lower drop volume. In this respect, the pens of a printer mechanism may be characterized by the ink(s) fired through the nozzles contained therein. By virtue of the various pen characterizations, the servicing operations, e.g., drop detection routines, wiping and capping cycles, etc., for each of the pens may be individually established. In one respect, the servicing operations performed on some of the pens may be set to occur more frequently than on other pens. In another respect, the timing of the servicing operations for each of the pens may be predicated upon a selected printmode to thereby substantially comply with a user's expectations of throughput and print quality.

By operation of the present invention, omission of the substantially continuous servicing operations, e.g., ink drop detections, of all of the pens as a matter of routine may be possible, without negatively impacting the quality of a printed output in a substantial manner. Instead, by performing a relatively lesser number of and/or less frequent servicing operations on certain pens based on their characterizations, the throughput of printing operations may be relatively improved without substantially affecting the quality of the printed output in a substantially adverse manner.

The characterization of the nozzles based upon the ink drop(s) fired therefrom may be predicated upon a selected printmode. For example, the pens configured to fire the ink drop(s) having certain degrees of impact on the printed output may undergo servicing operations more frequently in one printmode as compared to a different printmode. In this respect, the throughput and the print quality may be adjusted according to user preferences.

According to an aspect of the present invention, the amount of time required to perform ink drop detections may be further reduced by characterizing the nozzles of pens determined to have a greater impact on the print quality of the printed output. For example, nozzles may be characterized as standing a greater likelihood of failure. Servicing operations may be performed on those nozzles more frequently as compared to nozzles that have been identified as standing less of a risk of failure. It has been found that nozzles determined to be in good operating condition tend to remain in good operating condition, barring any relatively detrimental occurrences befalling the nozzles, e.g., paper crashes,jams, etc. It is therefore possible to forego continuous servicing operations on those nozzles as a matter of routine, without negatively impacting the quality of a printed output in a substantial manner. Instead, by performing servicing operations on those nozzles that stand a greater likelihood of failure, it may be determined when they fail and a printing mask may be created to substantially hide those nozzles. Thus, by selectively performing a greater number of and/or more frequent servicing operations on those nozzles that stand a greater likelihood of failure, it may be possible to both reduce the amount of time required to test the nozzles as well as substantially any negative impact on print quality caused by operation of those nozzles.

In one respect, the characterization of the nozzles as standing a greater likelihood of failure may be based upon the selected printmode. Thus, a predetermined threshold of timing of servicing operation performance may be associated with the selected printmode, e.g., draft, print, or the like. In addition, the determination of which nozzles to perform servicing operations upon may also be based upon the selected printmode. In this respect, the throughput and the print quality may be adjusted according to user preferences.

FIG. 1 illustrates an embodiment of a printer 20 constructed in accordance with the principles of the present invention, which may be used for recording information onto a recording medium, such as, paper, textiles, and the like, in an industrial, office, home or other environment. The present invention may be practiced in a variety of printers. For instance, it is contemplated that an embodiment of the present invention may be practiced in large scale textile printers, desk top printers, portable printing units, copiers, cameras, video printers, and facsimile machines, to name a few. For convenience, the concepts of the present invention are illustrated in the environment of a printer 20.

While it is apparent that the printer components may vary from model to model, the printer 20 includes a chassis 22 surrounded by a housing or casing enclosure 24, typically of a plastic material, together forming a print assembly portion 26 of the printer 20. In addition, the print assembly portion 26 may be supported by a desk or tabletop, however, it is preferred to support the print assembly portion 26 with a pair of leg assemblies 28. The printer 20 also has a printer controller 30, illustrated schematically as a microprocessor, that receives instructions from a host device, typically a computer, such as a personal computer or a computer aided drafting (CAD) computer system (not shown). A manner in which the controller 30 operates will be described in greater detail hereinbelow.

The printer controller 30 may also operate in response to user inputs provided through a key pad and status display portion 32, located on the exterior of the casing 24. A monitor coupled to the host device (not shown) may also be used to display visual information to an operator, such as the printer status or a particular program being run on the host device. Personal and drafting computers, their input devices, such as a keyboard and/or a mouse device, and monitors are all well known to those skilled in the art.

A conventional recording media handling system (not shown) may be used to advance a continuous sheet of recording media 34 from a roll through a printzone 35. The recording media may be any type of suitable sheet material, such as paper, poster board, fabric, transparencies, mylar, and the like. A carriage guide rod 36 is mounted to the chassis 22 to define a scanning axis 38, with the guide rod 36 slideably supporting a carriage 40 for travel back and forth, reciprocally, across the printzone 35. A conventional carriage drive motor (not shown) may be used to propel the carriage 40 in response to a control signal received from the controller 30. To provide carriage positional feedback information to controller 30, a conventional metallic encoder strip (not shown) may extend along the length of the printzone 35 and over a servicing region 42. An optical encoder reader may be mounted on the back surface of carriage 40 to read positional information provided by the encoder strip. The manner of providing positional feedback information via the encoder strip reader may also be accomplished in a variety of ways known to those skilled in the art.

Upon completion of printing an image, the carriage 40 may be used to drag a cutting mechanism across the final trailing portion of the media to sever the image from the remainder of the roll 34. Suitable cutter mechanisms are commercially available in DesignJet.RTM. 650C and 750C color printers. Of course, sheet severing may be accomplished in a variety of other ways known to those skilled in the art. Moreover, the illustrated printer 20 may also be used for printing images on pre-cut sheets, rather than on media supplied in a roll 34.

In the printzone 35, the recording medium receives ink from four cartridges 50–56. Although four cartridges 50–56 are illustrated, it is within the purview of the present invention that the printer 20 may contain any reasonably suitable number of cartridges, e.g., two, six, eight, twelve, and the like. For purposes of simplicity and illustration, the printer 20 will be described in terms of the four cartridges. It is to be understood, therefore, that additional cartridges may be implemented in the same or like manner as described hereinbelow with respect to cartridges 50–56. The cartridges 50–56 are also often called "pens" by those in the art. One of the pens, for example pen 50, may be configured to eject black ink onto the recording medium, where the black ink may contain a pigment-based ink. Pens 52–56 may be configured to eject variously colored inks, e.g., yellow, magenta, cyan, light cyan, light magenta, blue, green red, to name a few. For the purposes of illustration, pens 52–56 are described as each containing a dye-based ink of the colors yellow, magenta and cyan, respectively, although it is apparent that the color pens 52–56 may also contain pigment-based inks in some implementations. It is apparent that other types of inks may also be used in the pens 50–56, such as paraffin-based inks, as well as hybrid or composite inks having both dye and pigment characteristics.

The printer 20 uses an "off-axis" ink delivery system, having main stationary reservoirs (not shown) for each ink (black, cyan, magenta, yellow) located in an ink supply region 58. The term "off-axis" generally refers to a configuration where the ink supply is separated from the print heads 50–56. In this off-axis system, the pens 50–56 may be replenished by ink conveyed through a series of flexible tubes (not shown) from the main stationary reservoirs so only a small ink supply is propelled by carriage 40 across the printzone 35 located "off-axis" from the path of printhead travel. Some or all of the main stationery reservoirs may be located in a region generally away from the interior of the printer 20. In addition, the number of main stationary reservoirs may vary and is not required to equal the number of cartridges 50–56 utilized in the printer 20. In this respect, the printer 20 may include lesser or greater numbers of reservoirs than the number of cartridges 50–56. As used herein, the term "pen" or "cartridge" may also refer to a replaceable printhead cartridge where each pen has a reservoir that carries the entire ink supply as the printhead reciprocates over the printzone.

The illustrated pens 50–56 have printheads 60–66, respectively, which selectively eject ink to form an image on a sheet of media 34 in the printzone 35. These printheads 60–66 have a large print swath, for instance about 20 to 25 millimeters (about one inch) wide or wider, although the concepts described herein may also be applied to smaller printheads. The printheads 60–66 each have an orifice plate with a plurality of nozzles formed therethrough in a manner well known to those skilled in the art.

The nozzles of each printhead 60–66 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction substantially perpendicular to the scanning axis 38, with the length of each array determining the maximum image swath for a single pass of the printhead. The illustrated printheads 60–66 may comprise thermal inkjet or piezoelectric printheads, although other types of printheads may be used.

In general, thermal inkjet printheads typically include a plurality of resistors which are associated with the nozzles. Upon energizing a selected resistor, a bubble of gas is formed which ejects a droplet of ink from the nozzle and onto a sheet of print medium in the printzone 35 under the nozzle. The printhead resistors are selectively energized in response to firing command signals delivered from the controller 30 to the printhead carriage 40. Piezoelectric printheads typically include a plurality of piezoelectric elements (not shown), i.e., pieces of material that deform under the influence of an electric field to thus increase the pressure within a chamber, associated with the nozzles. Upon energizing a selected piezoelectric element, the space containing fluid to be fired through a nozzle is decreased and the pressure within the space is increased. The increased pressure causes a droplet of fluid to be forcibly ejected from the nozzle and onto the print medium in the printzone 35 under the nozzle. The piezoelectric elements are selectively energized in this manner in response to firing command signals delivered from the controller 30 to the printhead carriage 40.

Figure 2:
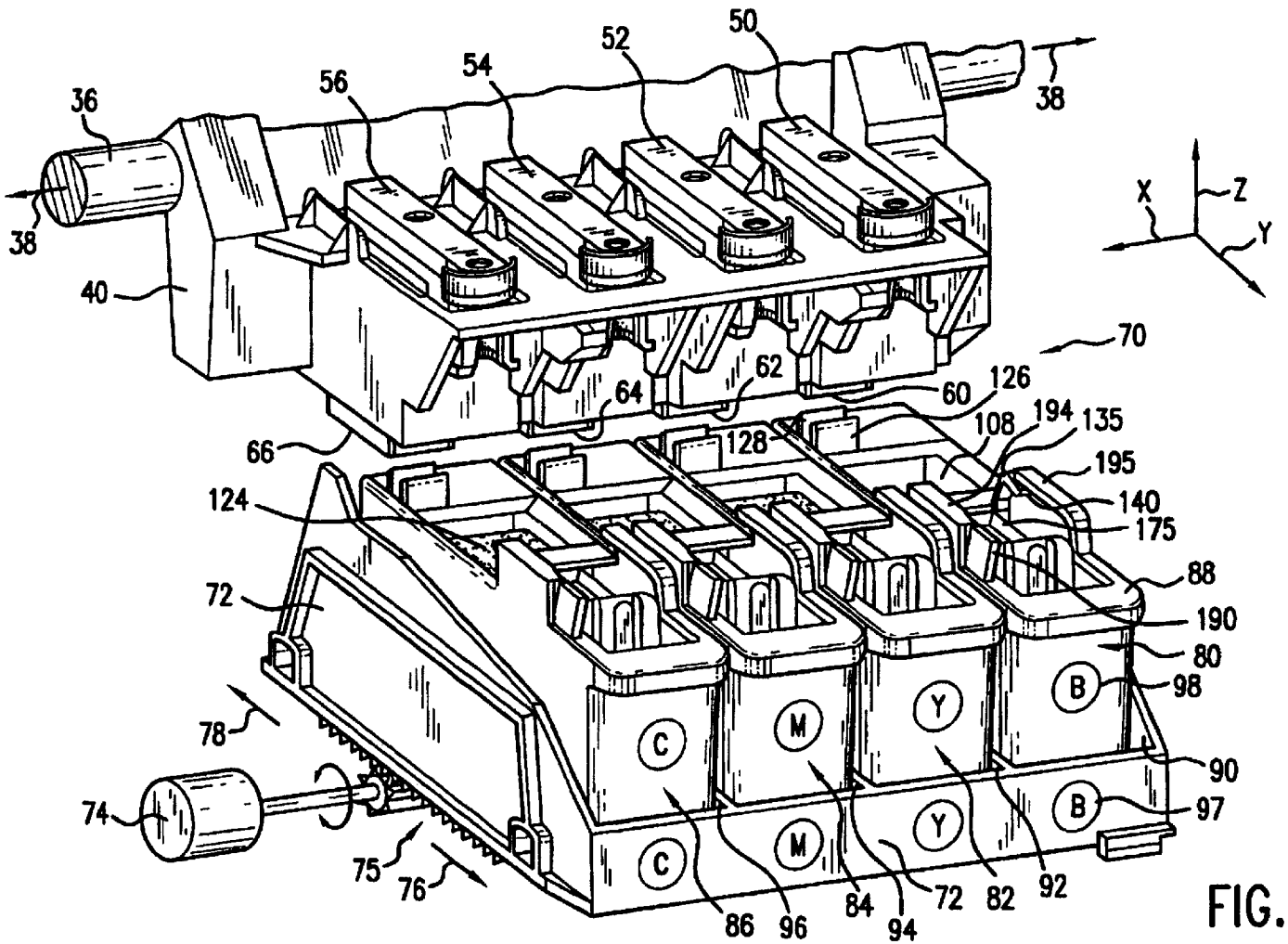
FIG. 2 is an enlarged perspective view of the service station system of FIG. 1.

FIG. 2 shows the carriage 40 positioned with the pens 50–56 ready to be serviced by a replaceable printhead cleaner service station system 70, constructed in accordance with the present invention. The service station 70 includes a translationally moveable pallet 72, which is selectively driven by motor 74 through a rack and pinion gear assembly 75 in a forward direction 76 and in a rearward direction 78 in response to a drive signal received from the controller 30. The service station 70 includes four replaceable inkjet printhead cleaner units 80, 82, 84 and 86, constructed in accordance with the present invention for servicing the respective printheads 50, 52, 54, and 56. Each of the cleaner units 80–86 includes an installation and removal handle 88, which may be gripped by an operator when installing the cleaner units 80–86 in their respective chambers or stalls 90, 92, 94, and 96 defined by the service station pallet 72. Following removal, the cleaner units 80–86 are typically disposed of and replaced with a fresh unit, so the units 80–86 may also be referred to as "disposable cleaner units." To aid an operator in installing the correct cleaner unit 80–86 in the associated stall 90–96, the pallet 72 may include indicia, such as a "B" marking 97 corresponding to the black pen 50, with the black printhead cleaner unit 80 including other indicia, such as a "B" marking 98, which may be matched with marking 97 by an operator to assure proper installation.

Each of the cleaner units 80–86 also includes a spittoon chamber 108 for receipt of spitted ink. For the color cleaner units 82–86 the spittoon 108 may be filled with an ink absorber 124, preferably of a foam material, although a variety of other absorbing materials may also be used. The absorber 124 receives ink spit from the color printheads 62–66, and holds this ink while the volatiles or liquid components evaporate, leaving the solid components of the ink trapped within the chambers of the foam material. The spittoon 108 of the black cleaner unit 80 may be supplied as an empty chamber, which then fills with the tar-like black ink residue over the life of the cleaner unit.

Each of the cleaner units 80–86 includes a dual bladed wiper assembly which has two wiper blades 126 and 128. Preferably, each of the wiper blades 126, 128 is constructed of a flexible, resilient, non-abrasive, elastomeric material, such as nitrile rubber, or more preferably, ethylene polypropylene diene monomer (EPDM), or other comparable materials known in the art. For the wiper blades 126 and 128, a suitable durometer, that is, the relative hardness of the elastomer, may be selected from the range of 35–80 on the Shore A scale, or more preferably within the range of 60–80, or even more preferably at a durometer of 70+/−5, which is a standard manufacturing tolerance.

For assembling the black cleaner unit 80, which is used to service the pigment based ink within the black pen 50, an ink solvent chamber (not shown) receives an ink solvent, which is held within a porous solvent reservoir body or block installed within the solvent chamber. Preferably, the reservoir block is made of a porous material, for instance, an open-cell thermoset plastic such as a polyurethane foam, a sintered polyethylene, or other functionally similar materials known to those skilled in the art. The inkjet ink solvent is preferably a hygroscopic material that absorbs water out of the air, because water is a good solvent for the illustrated inks. Suitable hygroscopic solvent materials include polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have an almost zero vapor pressure. For the purposes of illustration, the reservoir block is soaked with the preferred ink solvent, PEG.

To deliver the solvent from the reservoir, the black cleaner unit 80 includes a solvent applicator or member 135, which underlies the reservoir block.

Each of the cleaner units 80–86 also includes a cap retainer member 175 which can move in the Z axis direction, while also being able to tilt between the X and Y axes, which aids in sealing the printheads 60–66. The retainer 175 has an upper surface which may define a series of channels or troughs, to act as a vent path to prevent depriming of the printheads 60–66 upon sealing.

Each of the cleaner units 80–86 also includes a snout wiper 190 for cleaning a rearwardly facing vertical wall portion of the printheads 60–66, which leads up to an electrical interconnect portion of the pens 50–56. The snout wiper 190 includes a base portion which is received within a snout wiper mounting groove 194 defined by the unit cover. While the snout wiper 190 may have combined rounded and angular wiping edges as described above for wiper blades 126 and 128, blunt rectangular wiping edges are preferred since there is typically no need for the snout wiper to extract ink from the nozzles. The unit cover also includes a solvent applicator hood 195, which shields the extreme end of the solvent applicator 135 and the a portion of the retainer member 175 when assembled.

Figure 3:
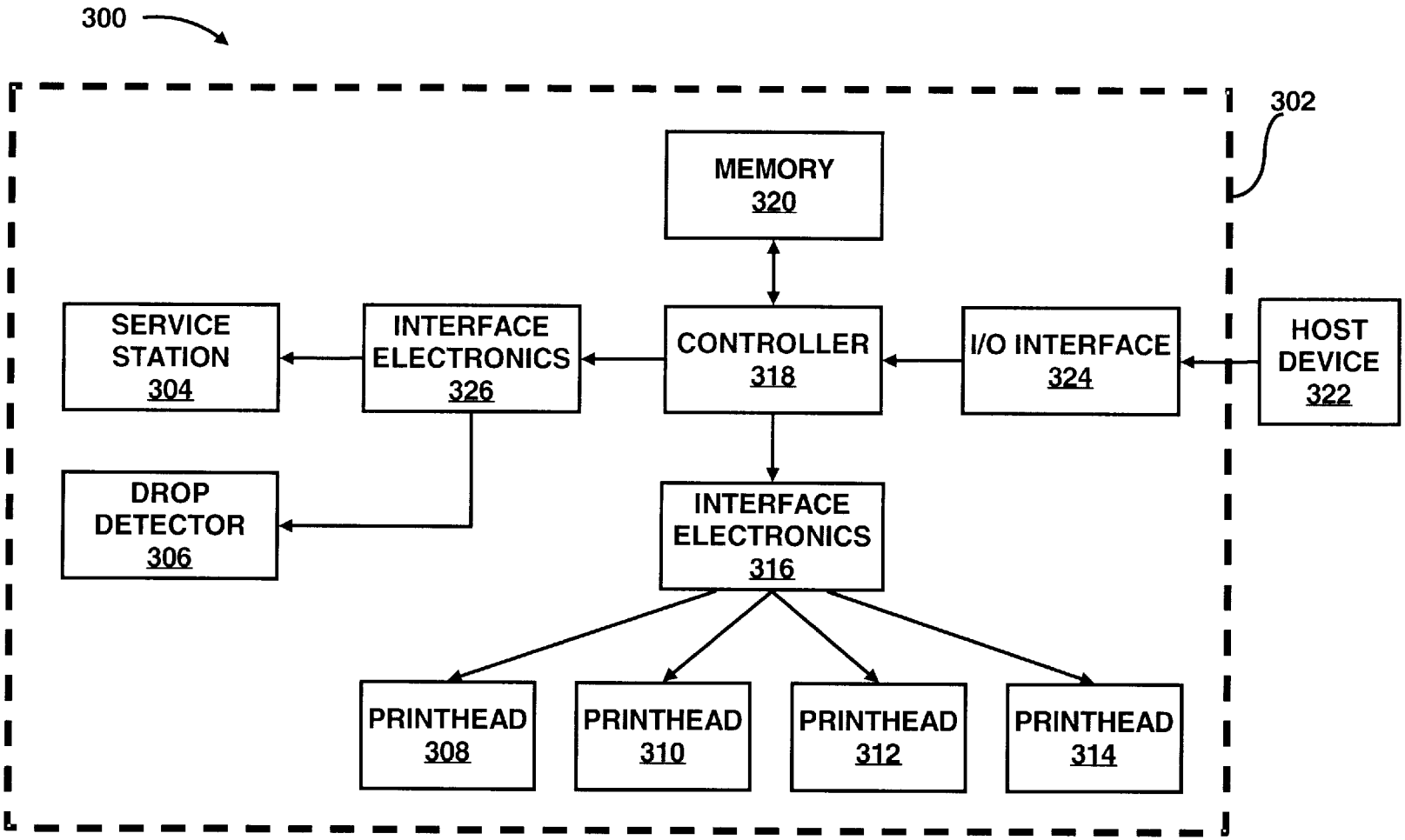
FIG. 3 is an exemplary block diagram of a printing mechanism in accordance with an embodiment of the present invention.

Referring to FIG. 3, there is illustrated an exemplary block diagram 300 of a printer 302 in accordance with an embodiment of the present invention. The following description of the block diagram 300 illustrates one manner in which a printer 302 having a service station 304, a drop detector 306, and a plurality of printheads 308–314 may be operated in accordance with an exemplary embodiment of the invention. In this respect, it is to be understood that the following description of the block diagram 300 is but one manner of a variety of different manners in which such a printer 302 may be operated.

The printer 302 may include interface electronics 316. The interface electronics 316 may be configured to provide an interface between the controller 318 of the printer 302 and the components for moving the printheads 308–314, e.g., a carriage, belt and pulley system (not shown), etc. The interface electronics 316 may also include, for example, circuits for advancing the print medium, firing individual nozzles of the printheads 308–314, and the like.

The controller 318 may be configured to provide control logic for the printer 302, which provides the functionality for the printer. In this respect, the controller 318 may possess a microprocessor, a micro-controller, an application specific integrated circuit, and the like. The controller 318 may be interfaced with a memory 320 configured to provide storage of an application program software that provides the functionality of the printer 302 and may be executed by the controller. The memory 320 may also be configured to provide a temporary storage area for data/file received by the printer 302 from a host device 322, such as a computer, server, workstation, and the like. The memory 320 may be implemented as a combination of volatile and non-volatile memory, such as dynamic random access memory ("RAM"), EEPROM, flash memory, and the like. It is also within the purview of the present invention that the memory 320 may be included in the host device 316. In addition, the host device 322 may be incorporated with the printer 302 as an integral mechanism. In this respect, the printer 302 may be operable to directly receive files from a user, the Internet, and the like.

The controller 318 may further be interfaced with an I/O interface 324 configured to provide a communication channel between the host device 322 and the controller 318. The I/O interface 324 may conform to protocols such as RS-232, parallel, small computer system interface, universal serial bus, etc.

In addition, the controller 318 may be interfaced with the service station 304 and the drop detector 306 through interface electronics 326. The interface electronics 326 may be configured to provide an interface between the controller 318 of the printer 302 and the components for operating the service station 304 and the drop detector 306, e.g., performing wiping functions on the printheads 308–314, capping the nozzles of the printheads, activating and deactivating the drop detector 304, etc. In this respect, the controller 318 may be configured to control the operations of the service station 304 (e.g., wiping, capping, and the like) as well as the drop detector 306 (e.g., when to perform the ink drop detections, which nozzles to perform the ink drop detections upon, and the like).

The drop detector 306 may comprise any reasonably suitable drop detector as is known to those skilled in the art. In this respect, the drop detector 306 may comprise any reasonably suitable commercially available drop detector. Examples of suitable drop detectors may include the optical drop detection device described in U.S. Pat. No. 6,238,112, the drop detector described in U.S. Pat. No. 6,086,190, and the piezoelectric membrane drop detector described in U.S. Pat. No. 4,835,435, all of which are currently assigned to the present assignee, the Hewlett-Packard Company. The disclosures contained in the above-cited patents are hereby incorporated by reference in their entireties.

During a so-called "normal" drop detection operation often implemented by conventional inkjet printers, each nozzle in each of the printheads 308–314 may release a sequence of ink droplets into the drop detector 306 in response to an instruction from the printer 302. The drop detector 306 generally operates to detect various characteristics of the released ink droplets. For example, the drop detector 306 may determine whether any ink drops were ejected during the drop detection operation. Those nozzles that have been determined as having failed to eject any ink drops may be replaced by other functioning nozzles during printing operations by application of print masks as is known to those of skill in the art. Other characteristics include the volume and the velocity of the ink drops ejected during the ink drop detection operation. Exemplary manners in which these characteristics of the ejected ink drops may be detected are discussed in the U.S. Patents cited hereinabove.

Although FIG. 3 illustrates four printheads 308–314, one drop detector 306 and one service station 304, any reasonably suitable numbers of these components may be implemented in the printer 302 without departing from the scope and spirit of the present invention.

Figure 4:
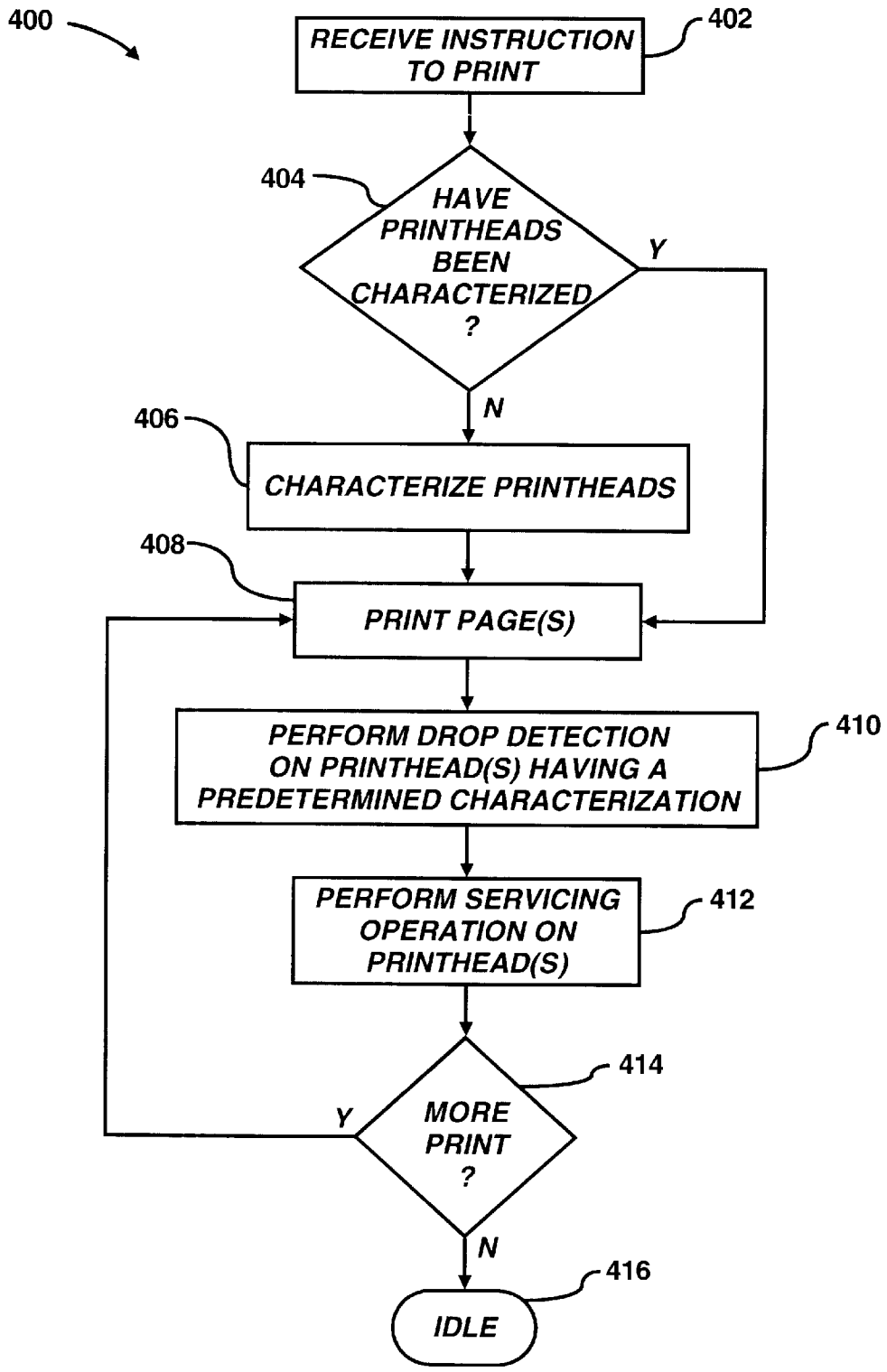
FIG. 4 is an exemplary flow diagram of a manner in which an embodiment of the present invention may be practiced.

Referring now to FIG. 4, there is illustrated an exemplary flow diagram of a method 400 by which an embodiment of the present invention may be practiced. The following description of the method 400 is made with reference to the block diagram illustrated in FIG. 3, and thus makes reference to the elements illustrated therein. It is to be understood that the steps illustrated in the method 400 may be contained as a program, subroutine or utility in any desired computer accessible medium. In addition, the method 400 may be performed by a computer program, which can exist in a variety of forms both active and inactive. For example, they can exist as software program(s) comprised of program instructions in source code, object code, executable code or other formats. Any of the above can be embodied on a computer readable medium, which include storage devices and signals, in compressed or uncompressed form. Exemplary computer readable storage devices include conventional computer system RAM (random access memory), is ROM (read only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. Although particular reference is made in the following description of FIG. 4 to the controller 318 as performing certain functions, it is to be understood that those functions may be performed by any electronic device capable of executing the above-described functions.

At step 402, the printer 302 may receive an instruction to print a plot, e.g., text, images, etc. The instruction to print the plot may be received from a variety of various sources. The sources my include, for example, the host device 322, the memory 320, the Internet, the printer 302, etc. The instruction to print may include the type of printing operation (e.g., color, grayscale, glossy, line printing, and the like) to be performed as well as the selected printmode (e.g., draft, best quality, etc.).

At step 404, the controller 318 may determine whether the printheads 308–314 have been characterized. If the printheads 308–314 have not been characterized, the printheads may be characterized at step 406. As described above, the printheads 308–314 may be characterized according to the properties of the ink drops (e.g., colors, chemical compositions, drop volumes, etc.) fired from each of the printheads. More specifically, the characterization may be based upon the degree of impact each of the ink drops may have on the quality of the printed output. For example, the degree of impact may correspond to the color of the ink drops fired from each of the printheads 308–314, e.g., a missing black line may have greater impact than a missing yellow line. In addition, the degree of impact of each ink drop may vary according to the type of printing operation to be performed. For example, in a printing operation where only a specific color of ink (e.g. black, yellow, and the like) is to be applied onto the print medium, the other inks would have virtually no impact on the print quality. In this instance, therefore, those printheads configured to fire the other ink drops would be characterized as having little to no impact on the print quality.

In addition, the degree of impact on the quality of the printed output may be based upon the selected printmode. In other words, certain printmodes may allow for a greater number of printing defects than other printmodes. Thus, certain defects in the quality of the printed output may be acceptable for certain printmodes whereas they may be unacceptable in other printmodes.

Depending upon the type of printing operation to be performed and the selected printmode, a characterization look up table (CLUT) may be referenced by the controller 318 to determine how each of the printheads 308–314 may be characterized. The CLUT may be stored in the memory 320 for access by the controller 318. The properties of the ink drops configured to be fired from each of the printheads 308–314 as well as their impacts on the printed output may be set and input into the memory 320. As shown in Table 1 below, a sample CLUT for the needed reliability for each of the selected printmodes may be created.

TABLE 1

| printmode | cyan | magenta | yellow | black | light cyan | light magenta |
|---|---|---|---|---|---|---|
| plain fast | 10% | 10% | 10% | 25% | 0% | 0% |
| plain normal | 25% | 25% | 25% | 50% | 5% | 5% |
| plain best | 75% | 75% | 75% | 100% | 10% | 10% |
| glossy normal | 70% | 70% | 70% | 0% | 60% | 60% |
| glossy best | 90% | 90% | 90% | 0% | 80% | 80% |

With reference to Table 1, the reliability needs for each pen may be determined according to a selected printmode and the type of media to receive ink drops. In Table 1, there is illustrated three printmodes for plain media (e.g., paper) and two printmodes for glossy media. In addition, each of the colors represents a respective printhead. It should be understood that the number of printheads, printmodes and media types enumerated in Table 1 are for illustrative purposes only and that the specific information provided in Table 1 are thus not meant to limit the present invention in any respect.

By way of example, when printing onto plain media, e.g., printing text onto white paper, lighter color ink drops will be used relatively less frequently than the darker color ink drops. Therefore, the lighter color ink drops have relatively less impact on the print quality as compared to the darker color ink drops. In this respect, the levels of reliability for lighter colors and their respective printheads are considerably less than those for darker colors. In addition, as the quality of the printmode increases, so does the required level of reliability for each of the printheads. Thus, the cyan printhead may be checked only 10% of the times a drop detection is scheduled in the fast printing mode and 75% of the times in the best printmode.

As another example, when printing onto glossy media, e.g., printing a color picture, reliability for each of the color printheads must be maintained at relatively high levels. The black printhead may not be used due to the incompatibility of black pigmented ink with glossy media. Thus, the black printhead may not undergo any drop detections during the printing operation, regardless of the printmode. However, each of the other colors may undergo drop detections more frequently as compared to printing operations performed on plain media.

As may further be gleaned from Table 1, some risks in ink drop reliability may be taken with those printheads configured to fire ink drops having colors that may not impact the printed output beyond a predetermined level. In addition, the level of impact for each printhead may vary according to the type of media to be printed upon as well as the selected printmode.

If the printheads 308–314 have been characterized or following step 406, a printing operation may be performed at step 408. Upon completion of the printing of a predetermined portion of the printing operation, e.g., a plurality of lines, a page, two pages, etc., a drop detection may be performed on printhead(s) having a predetermined characterization, e.g., those printhead(s) that fire ink drops having a predetermined degree of impact on the printed output, at step 410. In addition, the drop detection may be performed at the end or the beginning of the printing operation. The timing of the drop detection performance may be predicated upon the type of printing operation as well as the selected printmode. For example, a printing operation that requires relatively few ink drop applications and a relatively high quality may require substantially frequent drop detection performances.

The printhead(s) 308–314 designated to undergo drop detection performance may be selected according to the type of printing operation and the selected printmode. In this respect, a designation look up table (DLUT) may be referenced by the controller 318 to determine which of the printheads 308–314 are to undergo drop detection. The DLUT may be stored in the memory 320 for access by the controller 318. The controller 318 may designate those printheads 308–314 that surpass or exceed a predetermined threshold level of impact on the printed output. For example, for a printing operation performed on standard media in a draft printmode, the printhead configured to print black ink may exceed the predetermined threshold level of impact whereas the printhead configured to print yellow ink may fall below the predetermined threshold level of impact. Thus, in this situation, the printhead configured to print black ink may undergo drop detection at step 410 whereas the printhead configured to print yellow ink may not undergo drop detection at step 410.

At step 412, some or all of the printheads 308–314 may undergo servicing operations (e.g., spitting, wiping, capping, etc.). The servicing operations may be performed on those printhead(s) configured to fire ink drops having a predetermined degree of impact on the printed output.

At step 414, it may be determined whether additional printing operations (e.g., complete the current printing operation, start another printing operation, etc.) are to be performed. If additional printing operations are to be performed, the steps beginning at step 408 may be repeated for an indefinite period of time. If no additional printing operations are required, the printer 302 may enter an idle mode as indicated at step 416, e.g., stand-by, sleep, shutdown, etc. In addition, drop detection of each of the printheads 308–314 may be performed during an "into cap" routine. The "into cap" routine, as the name generally implies, refers to a drop detection and servicing routine that is performed substantially immediately after a printing operation has been performed. This is a preferred time to perform the drop detection on the all of the printheads 308–314 because there are typically no immediately pending print jobs and thus no relatively adverse affect on throughput during this period.

In accordance with the above-described preferred embodiment, the time required to perform servicing operations on the printheads 308–314 may be reduced by a substantial amount, thereby increasing the throughput of the printing operation. More specifically, by performing servicing operations on those printheads 308–314 that may exceed a predetermined threshold level of impact on the printed output while omitting the performance of servicing operations on those printheads that may not exceed the predetermined threshold level of impact, the amount of time required to perform the servicing operations may be reduced. Thus, the throughput of the printing operation may be increased.

According to a second embodiment of the invention, the time required to perform drop detections on the printheads 308–314 may be further reduced by implementation of a focused drop detection. Focused drop detection generally refers to a technique in which those nozzles of a printhead that have a greater likelihood of causing printing defects may undergo drop detections relatively more frequently than those nozzles determined to have a lesser likelihood of failure. In this respect, the nozzles of the printheads 308–314 may be characterized according to their likelihood of causing printing defects. According to these characterizations, drop detections may be performed more frequently on nozzles characterized as standing a greater likelihood of failure as compared to nozzles that have been identified as standing less of a risk of failure. It has been found that nozzles determined to be in relatively good operating condition tend to remain in relatively good operating condition, barring any relatively detrimental occurrences befalling the nozzles, e.g., paper crashes, jams, etc. It is therefore possible to forego continuous drop detection on those nozzles as a matter of routine, without negatively impacting the quality of a printed output in a substantial manner. Instead, by performing drop detections on those nozzles that stand a greater likelihood of failure, it may be determined when they fail and a printing mask may be created to substantially hide those nozzles during the printing operation. Thus, by selectively performing a greater number of and/or more frequent drop detections on those nozzles that stand a greater likelihood of failure, it may be possible to both reduce the time required to test the nozzles as well as substantially any negative impact on print quality caused by operation of those nozzles.

In one respect, the characterization of the nozzles as standing a greater likelihood of failure may be based upon the selected printmode. Thus, a predetermined threshold of timing of drop detection performance may be associated with the selected printmode, e.g., draft, print, or the like. In addition, the determination of which nozzles to perform drop detection upon may also be based upon the selected printmode. In this respect, the throughput and the print quality may be adjusted according to user preferences.

The characterization of the nozzles may be predicated upon their performances during drop detections. For example, some drop detectors may be capable of determining the velocity of the ejected ink drop based upon the amount of time an ink drop required to trigger a sensing mechanism after receiving a firing command (e.g., a light beam in an optical detector, an electrostatic sensing element, and the like). In addition, an electrostatic drop detector may detect the volume of the ejected ink drop based upon the amount of electrical charge transferred to an electrostatic sensing element. Based upon the detected velocity and/or the volume of the ejected ink drop, the condition of the nozzle that fired the ink drop may be characterized. For example, if the detected volume and/or volume of the ejected ink drop is within a predetermined operating range, the nozzle that fired the ink drop may be characterized as being "good".

Figure 5A:
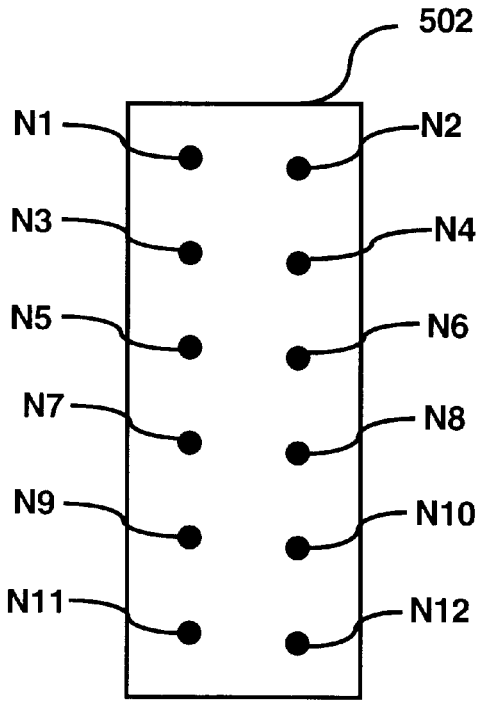
FIG. 5A is a bottom view of an exemplary printhead.
Figure 5B:
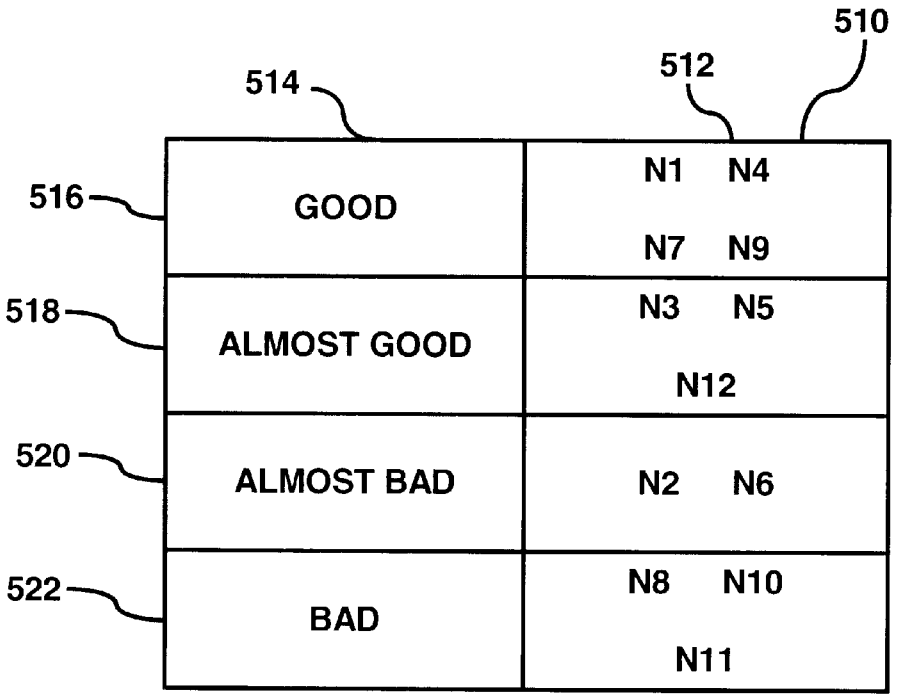
FIG. 5B is an exemplary chart in accordance with an embodiment of the present invention.

FIGS. 5A and 5B, together illustrate a manner in which the nozzles N1–N12 of an exemplary printhead 502 may be categorized. It should be understood that the printhead 502 illustrated in FIG. 5A is a simplified example of a printhead and therefore the number of nozzles depicted therein is for purposes of illustration and is not meant to limit the invention in any manner. In FIG. 5B, a chart 510 may be created to depict the categorization of each of the nozzles N1–N12 according to their detected conditions. In this respect, the chart 510 may include two columns 512 and 514 and four rows 516–522. The column 512 may contain the nozzles N1–N12 and the column 514 may contain the nozzle condition category. In addition, the rows 516–522 may contain the associations between the nozzle condition categories and the nozzles that fall within the selected nozzle condition categories. The number of condition categories and the manner in which the nozzles N1–N12 are categorized in FIG. 5A are not meant as limitations, rather, they are provided to illustrate one manner in which the present invention may be practiced.

The characterization of each of the nozzles N1–N12 may be stored in a memory device (e.g., a memory device of the drop detector 306, memory 320, in the host device 322, and the like). The characterization of the nozzles N1–N12 may be stored in the memory device in the form of the chart 510 and may be accessible by the controller 318 to determine which nozzles have been determined as requiring drop detection. The nozzles N1–N12 may be categorized into various groups that relate to their respective conditions. The number of groups into which the nozzles may be categorized may be predicated upon the level of distinction desired for the operation of the method according to the invention. In this respect, the number of groups are not limited to any described herein. Rather, the nozzles N1–N12 may be categorized into any reasonably suitable number of groups without deviating from the scope and spirit of the invention. Of course, the greater the number of groups available for distinguishing the conditions of the nozzles N1–N12, the greater the accuracy in determining the timing and which nozzles are to be tested. For example, the nozzles may be categorized into three groups consisting of good, almost bad, and bad nozzles. As another example, the nozzles N1–N12 may be categorized into four groups consisting of good, almost good, almost bad, and consistently bad or dead nozzles. For purposes of illustration, the invention will be described herein with reference to the four groups described hereinabove with respect to FIG. 5B. It should be understood that the use of four groups is not meant to limit the invention in any respect.

The nozzles N1–N12 may be characterized according to a deviation in their condition(s) from nominal operating conditions. For example, if a nozzle is operating at around 85–100% of its nominal operating condition(s), e.g., as set forth by the printhead manufacturer, printer manufacturer, through testing, etc., the nozzle may be characterized as being "good". As another example, if a nozzle is operating at around 70–85%, that nozzle may be characterized as "almost good". In addition, if a nozzle is operating at around 55–70%, that nozzle may be characterized as "almost bad" and if a nozzle is operation below around 55%, that nozzle may be characterized as "consistently bad" or "bad". The percentages enumerated above are for simplicity of description only and are therefore not meant to limit the invention in any respect. Instead, according to a preferred embodiment of the present invention, the condition categories may vary according to user preferences. In this respect, the condition categories may be predicated upon a selected printmode. For example, when a lesser quality printing operation is desired, e.g., draft printmode is selected, a nozzle may be characterized as "almost good" if it is determined to be operating at around 60–75%. Thus, a relatively lower threshold of operating condition may be set for lesser quality printing operations and a relatively higher threshold may be set for higher or better quality printing operations.

Figure 6:
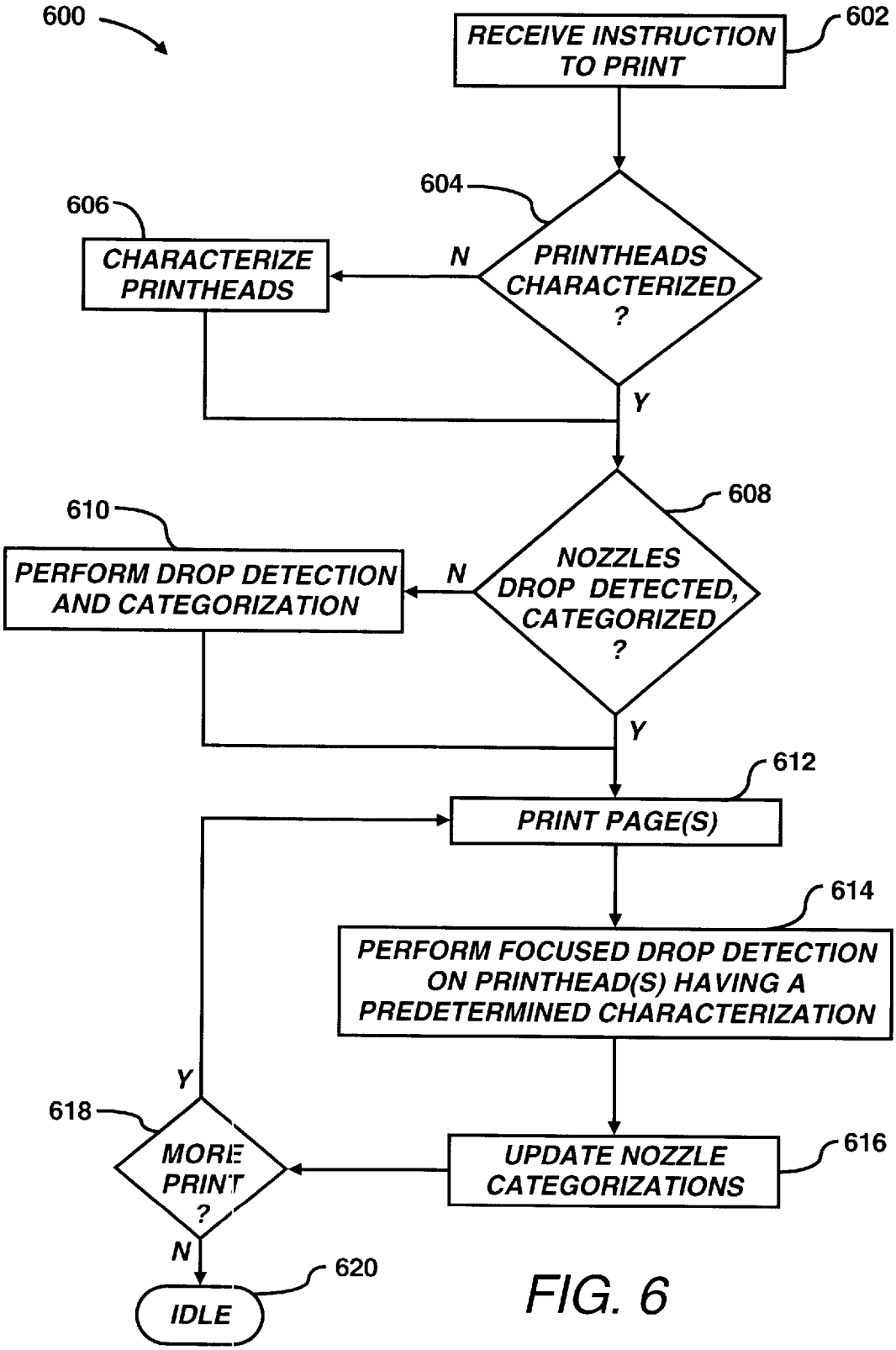
FIG. 6 is an exemplary flow diagram of a manner in which a second embodiment of the present invention may be practiced.

Referring to FIG. 6, there is illustrated an exemplary flow diagram of a method 600 by which an embodiment of the present invention may be practiced. The following description of the method 600 is made with reference to the block diagram illustrated in FIG. 3, and thus makes reference to the elements illustrated therein. It is to be understood that the steps illustrated in the method 600 may be contained as a subroutine, program or utility in any desired computer accessible medium. In addition, the method 600 may be performed by a computer program, which can exist in a variety of forms both active and inactive. For example, they can exist as software program(s) comprised of program instructions in source code, object code, executable code or other formats. Any of the above can be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. Although particular reference is made in the following description of FIG. 6 to the controller 318 as performing certain printer functions, it is to be understood that those functions may be performed by any electronic device capable of executing the above-described functions.

At step 602, the printer 302 may receive an instruction to print a plot, e.g., text, images, etc. The instruction to print the plot may be received from a variety of various sources. The sources my include, for example, the host device 322, the memory 320, the Internet, the printer 302 itself, etc. The instruction to print may include the type of printing operation (e.g., color, grayscale, glossy, line printing, and the like) to be performed as well as the selected printmode (e.g., draft, best quality, etc.).

Steps 604 and 606 are identical to steps 404 and 406 described hereinabove with respect to FIG. 4. Therefore, a description of steps 604 and 606 is omitted in favor of reliance upon the description of steps 404 and 406 found hereinabove.

Following step 604 or 606, the controller 318 may determine whether the nozzles have been drop detected and categorized at step 608. At step 610, if some of the nozzles have not been drop detected, and/or if some of the nozzles have not been categorized, a drop detection and/or categorization may be performed on the nozzles. If any of the nozzles has been previously characterized as "bad", e.g., nozzle-out, those nozzles may be withdrawn from the drop detection operation to thereby reduce the amount of time required to conduct the drop detection.

According to a preferred embodiment, the drop detection may be performed during an "into cap" routine. The "into cap" routine, as the name implies, generally refers to a drop detection and servicing routine that is performed substantially immediately after a printing operation has been performed and the printheads are capped in the service station. This is the preferred time to perform the drop detection on the nozzles, as well as the characterization of the nozzle conditions, because during this period, there are typically no immediately pending print jobs and thus no relatively adverse affects on throughput.

If the drop detection may not be performed during the "into cap" routine, the drop detection and characterization of the nozzle conditions may also be performed prior to performing a printing operation.

At step 612, after the nozzles have been drop detected and categorized, e.g., in the manner described hereinabove with respect to FIGS. 5A and 5B, the printing operation may begin. Some time after the printing operation has begun, e.g., after one or more printing passes, pages, etc., a focused drop detection may be performed on the printhead(s) having a predetermined characterization at step 614. The time the focused drop detection is performed may be predicated upon a servicing subroutine or it may be a function of the selected printmode. For example, if a lesser quality printing operation is selected, e.g., draft printmode, the focused drop detection may not occur until after printing a second or third page. In comparison, for example, if a better quality printing operation is selected, the focused drop detection may occur after printing a single page. In this respect, the timing of the drop detection operations as well as its frequency of occurrence, may be set forth by a user.

In performing the focused drop detection at step 614, the nozzles that undergo drop detection may vary according to the selected printmode. In this respect, if a relatively lesser quality printing operation, e.g., draft printmode, is selected, those nozzles categorized under a predetermined condition category as well as those that fall below that category may be tested. For example, with reference to FIG. 5B, in the draft printmode, those nozzles in the "Almost Bad" category may be tested, i.e., nozzles N2 and N6. As another example, again with reference to FIG. 5B, if a higher quality printmode were selected, those nozzles N3, N5, and N12 in the "Almost Good" category and those nozzles N2 and N6 in the "Almost Bad" category may be tested. In any instance, those nozzles in the "Bad" category, i.e., and N8, N10, and N11, would not be tested because they have already been determined to be defective. It is possible, however, that the nozzles N8, N10, and N11 may be switched to another category if they are able to be recovered, e.g., undergo a successful recovery operation in a manner known to those skilled in the art.

According to a preferred embodiment of the present invention, at least one nozzle in a category, preferably of a higher condition, in addition to those enumerated above may be tested in the focused drop detection at step 614. The number of additional nozzles tested may be related to the selected printmode. In this respect, the higher or better the selected print quality, the greater the number of additional nozzles to be tested. For example, if the draft printmode were selected as described hereinabove, one nozzle from each of the "Good" and "Almost Good" categories may be tested along with those nozzles from the "Almost Bad" category. In addition, if a higher or better quality printmode were selected, more than one nozzle from the "Good" category may be tested along with those nozzles from the "Almost Good" and "Almost Bad" categories. The selection of the nozzles from the other categories may be based upon a predetermined subroutine that changes the nozzle tested during the performance of each another drop detection, or, the nozzles may be chosen in a random fashion.

At step 616, based upon the results of the focused drop detection, the categorization of the nozzles may be updated. In this respect, those nozzles that did not undergo drop detection may remain under the same category, whereas, those nozzles that have been detected as having either improved or deteriorated from a previous drop detection may be categorized under a different category.

At step 618, it may be determined whether additional printing operations are required. If additional printing operations are required, then step 612 may be performed with step 614 being performed some time thereafter. The timing of the performance of step 614 may be determined in accordance with the description set forth hereinabove. If additional printing operations are not required, printer may enter an idle mode at step 620, e.g., stand-by, sleep, shut-down, etc. According to a preferred embodiment, prior to entering an idle mode, the printer may perform an "into cap" routine as described hereinabove. In performing the "into cap" routine, all of the categories of the nozzles may be updated for use in a subsequent printing operation.

The examples cited hereinabove are for illustrative purposes only and are thus not meant to limit the invention in any respect. In addition, the examples made reference to FIGS. 5A and 5B, which are substantially simplified versions of an actual printhead 502 and an exemplary chart 510. It is generally known to those of skill in the art that typical printheads may include over 1000 nozzles. Thus, application of the principles of the present invention in a printhead having over 1000 nozzles may yield relatively substantial savings in time and ink.

By virtue of certain aspects of the present invention, the time required to perform drop detections during printing operations may be substantially reduced to thereby relatively increase the throughput of the printing operations. In one respect, only those printheads exceeding a predetermined threshold level of potentially negatively impacting the printed output are drop detected. In another respect, certain categories of nozzles within each of those printheads are drop detected to further reduce the time required to perform drop detections. For example, substantially only those nozzles that have been determined as having a relatively high risk of failure undergo a substantially major portion of the drop detection. Therefore, the number of printheads as well as the number of nozzles that undergo drop detection during a printing operation may be substantially reduced. Consequently, an increase in drop detection throughput may be realized which may increase the throughput of the printing operation. In addition, by substantially limiting performance of the drop detection operations on a reduced number of printheads and nozzles, the amount of ink utilized in performing the drop detection operations may be substantially reduced.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method of selective ink drop detection, said method comprising:

determining a degree of impact of ink drops configured to be fired from each of a plurality of printheads has on a printed output;

characterizing each of said printheads into at least one of a plurality of groups based upon said degree of impact of said ink drops; and performing a selective ink drop detection on a first printhead group configured to fire ink drops having a predetermined degree of impact on the printed output.

2. The method according to claim 1, wherein said step of characterizing each of said printheads comprises characterizing each of said printheads according to a property of ink drops configured to be fired from each of said printheads.

3. The method according to claim 2, wherein said step of characterizing each of said printheads comprises characterizing each of said printheads into said groups according to the color of ink configured to be fired from each of said printheads.

4. The method according to claim 2, wherein said step of characterizing each of said printheads comprises characterizing each of said printheads into said groups according to the drop volume of ink configured to be fired from each of said printheads.

5. The method according to claim 1, further comprising:

receiving a selected printmode; and setting printed output level of impact threshold conditions for characterization of said printheads in said first group in response to said selected printmode.

6. The method according to claim 5, further comprising:

setting a higher printed output level of impact threshold condition in response to a selected lower quality printing operation; and setting a lower printed output level of impact threshold condition in response to a selected a higher quality printing operation.

7. The method according to claim 1, further comprising:

performing a first drop detection on a plurality of nozzles prior to said selective servicing operation performance;

categorizing each of said nozzles into at least one of a plurality of nozzle condition groups based upon the results of said first drop detection, each of said nozzle condition groups corresponding to a predetermined nozzle condition;

storing said categorization of each of said nozzles in a memory; and wherein said performance of said selective ink drop detection comprises performing a second ink drop detection on a first nozzle condition group of nozzles.

8. The method according to claim 7, further comprising:

categorizing each of said plurality of nozzles based upon at least one characteristic of an ink drop fired from each of said plurality of nozzles.

9. The method according to claim 7, further comprising:

characterizing said first nozzle condition group of nozzles as falling below a predetermined threshold condition.

10. The method according to claim 9, further comprising:

receiving a selected printmode;

setting conditions for selection of said nozzles in said first group in response to said selected printmode;

setting a higher threshold condition in response to a selected lower quality printing operation; and setting a lower threshold condition in response to a selected a higher quality printing operation.

11. The method according to claim 7, further comprising:

receiving a selected printmode;

setting conditions for determination of a number of nozzles falling outside of said first group to detect in the performance of said second drop detection in response to said selected printmode;

setting a higher number of nozzles to detect falling outside of said first group in response to a selected higher quality printing operation;

setting a lower number of nozzles to detect falling outside of said first group in response to a selected lower quality printing operation; and performing said selective ink drop detection on said set number of nozzles falling outside of said first group.

12. The method according to claim 7, further comprising:

updating said categorization of each of said nozzles into at least one of said plurality of nozzle condition groups, based upon the results of said selective ink drop detection; and storing said updated categorization of each of said nozzles in said memory.

13. The method according to claim 7, wherein said step of categorizing each of said nozzles comprises the step of assigning each of said nozzles a score and wherein said step of performing said second drop detection comprises performing said second drop detection on a first group of nozzles having scores that fall within a predetermined range of scores.

14. The method according to claim 13, further comprising:

receiving a selected printmode;

setting said predetermined range of scores in response to said selected printmode, and wherein said step of performing said selective drop detection comprises performing said second drop detection on a percentage of said nozzles having scores falling within said predetermined range of scores, wherein said percentage of said nozzles corresponds to said selected printmode.

15. An apparatus for operating a printing mechanism having a plurality of printheads, each printhead being configured to fire ink having various degrees of impact on a printed output, said apparatus comprising:

a controller operable to control said plurality of printheads to fire ink drops onto a print medium to form said printed output;

a memory configured to store said varying degrees of impact of said ink drops configured to be fired through said printheads, wherein said controller is further operable to group said printheads according to said degrees of impact of said ink drops configured to be fired therefrom; and said controller being operable to a control at least one of said printhead groups to undergo a selective ink drop detection, wherein said at least one of said printhead groups are those printheads configured to fire ink drops having a predetermined degree of impact on the printed output.

16. The apparatus according to claim 15, wherein said printhead groupings stored in said memory are based upon at least one characteristic of said ink drops configured to be fired from each of said printheads.

17. The apparatus according to claim 16, wherein said controller is operable to determine which group of printheads to undergo said selective ink drop detection based upon a selected printmode.

18. The apparatus according to claim 15, wherein said controller is further operable to control said plurality of nozzles of each of said printheads to fire ink drops into a drop detector prior to performance of said selective servicing operation;

said drop detector being configured to determine a characteristic of said ink drops fired from each of said nozzles to thereby determine a condition of each of said nozzles;

said memory being configured to store said conditions of said nozzles, wherein said nozzles are characterized and stored in terms of their conditions, and wherein said nozzles are grouped in terms of their conditions; and said controller being operable to a control at least one group of said nozzles of said printheads to undergo a second ink drop detection.

19. The apparatus according to claim 18, wherein said controller is operable to determine and control which group of nozzles to undergo said selective ink drop detection and wherein said determination of which group of nozzles to undergo said selective ink drop detection is based upon a selected printmode.

20. The apparatus according to claim 19, wherein said controller is operable to determine and control at least one nozzle outside of said at least one group of said nozzles to undergo said selective ink drop detection, wherein said determination of said at least one nozzle outside of said at least one group of said nozzles is based upon said selected printmode.

* * * * *